United States Patent [19]

Aono

[11] 4,046,118

[45] Sept. 6, 1977

[54] AIR FUEL MIXTURE CONTROL APPARATUS FOR CARBURETED INTERNAL COMBUSTION ENGINES

[75] Inventor: Shigeo Aono, Tokyo, Japan

[73] Assignee: Nissan Motor Co., Ltd., Yokohama, Japan

[21] Appl. No.: 630,043

[22] Filed: Nov. 7, 1975

[30] Foreign Application Priority Data

Nov. 8, 1974 Japan ..... 49-128612

[51] Int. Cl.[2] ..... F02B 33/00; F02M 7/00

[52] U.S. Cl. ..... 123/119 EC; 261/121 B; 60/276; 123/32 EE

[58] Field of Search ..... 261/121 B; 123/119 EC; 60/274, 276, 285; 123/32 EE

[56] References Cited

U.S. PATENT DOCUMENTS

| | | | |
|---|---|---|---|
| 3,763,009 | 6/1976 | Mennesson | 123/119 EC |
| 3,861,366 | 1/1975 | Masaki | 123/119 EC |
| 3,921,612 | 11/1975 | Aono | 123/119 EC |
| 3,942,493 | 3/1976 | Linder | 123/119 EC |

*Primary Examiner*—Carroll B. Dority, Jr.
*Assistant Examiner*—Ronald B. Cox
*Attorney, Agent, or Firm*—Lowe, King, Price & Markva

[57] ABSTRACT

Air-fuel mixture control apparatus for a carbureted internal combustion engine having air bleed and fuel supply passages comprises a detector for sensing pre-combustion data such as engine operating parameters and an exhaust gas sensor for providing post-combustion data. The pre-combustion data is used to control the fuel flow rate, while the post-combustion data controls the passage of air through the air bleed. The pre-combustion data minimize the delay from the instant of disturbance to the engine to the instant at which a response is observed.

10 Claims, 14 Drawing Figures

OUTPUT VOLTAGE
RICH
LEAN 22
22a
22a'
22a''
22b
22c
22d
22e
22f
FUNCTION GENERATOR
DIFF
AMPL.
FUNCTION GENERATOR
FUNCTION GENERATOR
FUNCTION GENERATOR
FUNCTION GENERATOR
FROM THROTTLE SENSOR 23
FROM INTAKE VAC. SENSOR 24
FROM TEMP. SENSOR 25
FROM ENGINE SPEED SENSOR 26
FROM CONTROLLER 19
TO PULSE WIDTH MODULATOR 27

AIR FUEL MIXTURE CONTROL APPARATUS FOR CARBURETED INTERNAL COMBUSTION ENGINES

The present invention relates generally to air fuel mixture control apparatus for internal combustion engines, and more specifically to a closed loop air fuel mixture control apparatus for an internal combustion engine of the carburetor type.

Closed loop control is known in the art for controlling air fuel mixture ratio at stoichiometry. An oxygen sensor is provided in the exhaust passage of an engine to derive an error signal which is used to control the air fuel ratio at the stoichiometric value. Under normal driving conditions, the departure from stoichiometry which must be corrected is as much as 10% of the stoichiometric value and which can be corrected by controlling the passage of air through an air bleed. However, the departure could often exceed a 50% value when an external disturbance should occur such as caused by sudden acceleration or deceleration of vehicle during the warm-up condition.

The primary object of the invention is therefore to provide an improved closed loop control system which is capable of compensating a wide range of departure from stoichiometry.

Another object of the invention is to provide an improved closed loop control system having a fast response characteristic.

A further object of the invention is to provide an improved closed loop control system which senses pre-combustion engine conditions for compensating for the delay from the instant of disturbance to the system to the instant at which a response is observed. Briefly described, air fuel mixture ratio control apparatus of the present invention includes an exhaust gas sensor, for example, oxygen sensor disposed in the exhaust passage of an internal combustion engine of the carburetor type and at least one sensor for detecting an operating parameter of the engine. The oxygen sensor reacts with the amount of oxygen in the exhaust gases and provides an output voltage with a very sharp characteristic change in amplitude at the stoichiometric air fuel ratio. The output voltage is compared with the desired value. The difference between the values or the error signal is modulated by a controller circuit, e.g., proportional-integral controller. The engine parameter sensor reacts with the throttle opening, for example, and provides a corresponding output signal which is modified by a function generator which in turn produces an output voltage which varies in accordance with the throttle-versus-fuel characteristic of the engine. This throttle-fuel characteristic voltage represents one of pre-combustion data of the internal combustion engine, while the output from the oxygen sensor represents post-combustion data. The pre-combustion data are used to compensate for the delay which is defined as the time from the instant of disturbance to the system until a response is observed. The time delay corresponds to the time required for the transportation of mass or energy and is related to the time for the fuel and air mixture to reach the cylinders, be inducted, combusted, exhausted, and then travel through the exhaust system to the sensor. Other pre-combustion data may include those derived from sensors strategically placed around the engine such as engine temperature sensor, intake vacuum pressure sensor and engine speed sensor. The outputs from these sensors are modified in accordance with particular operating characteristics of the engine.

The pre-combustion data are used to operate an electromagnetic valve disposed in the passage of fuel supply, while the post-combustion data are used to operate another electromagnetic valve situated in the passage of air bleed. Therefore, the amounts of fuel and air are controlled by the pre-combustion and post-combustion data, respectively, so that departure from the desired air-fuel ratio due to a disturbance is rapidly compensated for and the air fuel ratio brought back to the specified set point.

The present invention will be further described in conjunction with the accompanying drawings, in which.

Figure 1:
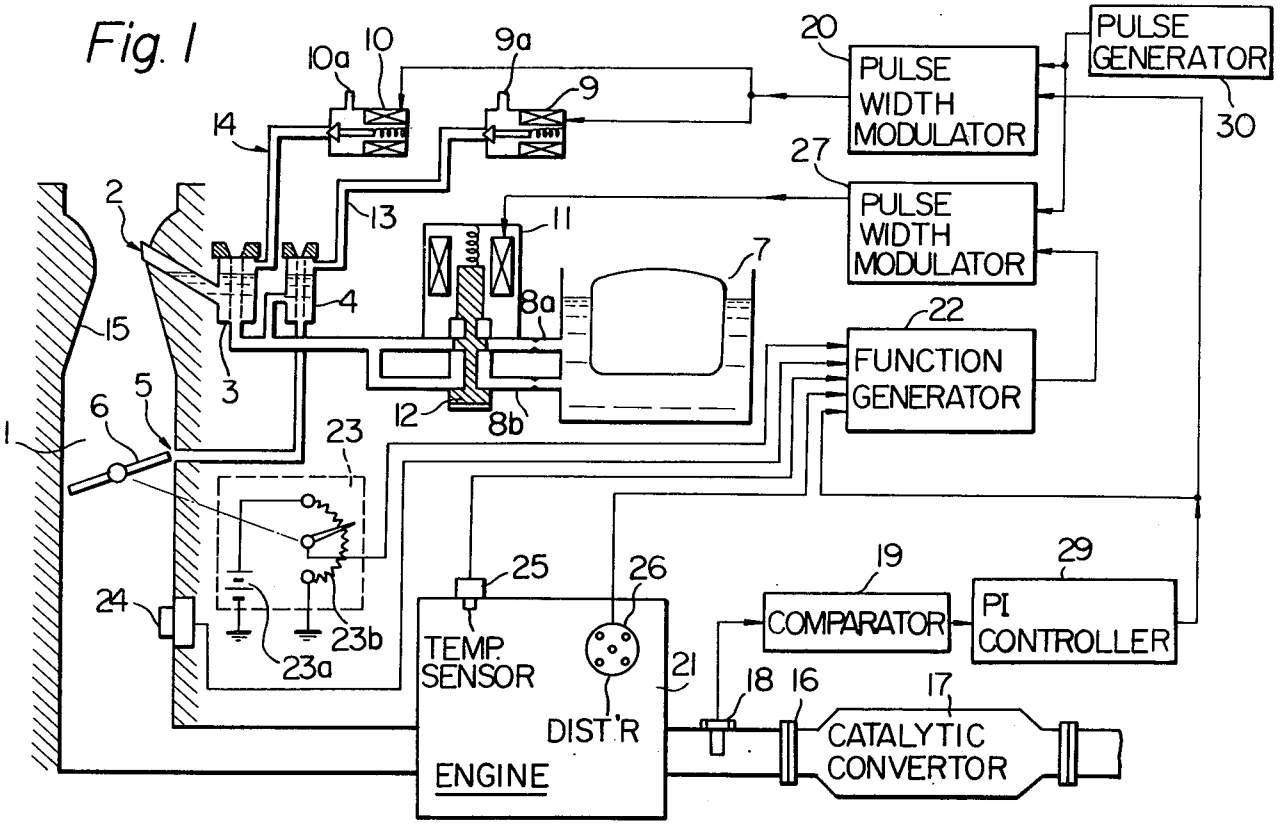
FIG. 1 is a circuit diagram of an embodiment of the present invention.

Referring now to FIG. 1 a general circuit diagram of the air fuel mixture control circuit of the invention is shown. Reference numeral 1 indicates the intake passageway of an automobile connected to a cylinder of an engine 21. A discharge nozzle 2 is provided at the venturi 15 of the intake passageway 1. The discharge channel 2 is in communication with an emulsion chamber 3 which has its air inlet port connected to an electromagnetic valve 10. An emulsion tube 4 is in communication with an idle port 5 adjacent to the fully closed position of the throttle valve and has its air inlet port connected to an electromagnetic valve 9. The emulsion tubes 3 and 4 have their fuel inlet ports connected in common to a fuel supply 7 via bifurcated passageways **8*a* and 8*b*. The passageways 8*a* and 8*b* have restrictions having different diameters to permit fuel to be supplied at different rates. To achieve the different flow rates, an electromagnetic valve 11 is provided having a plunger 12 disposed in the respective passages 8*a* and 8*b* in such manner than either one of the passageways 8*a* and 8*b* is blocked while the other is allowed to pass fuel to the emulsion chambers 3 and 4. The electromagnetic valves 9 and 10 are operated by control pulses supplied from a pulse width modulator 20, and the electromagnetic valve 11 is under the control of a pulse width modulator 27. Air is admitted through ports 9*a* and 10*a* of valves 9 and 10, respectively, through air bleed passageways 13 and 14 to the emulsion tubes 3 and 4, respectively, where fuel is mixed with the air to provide emulsion. By controlling the width of the pulse supplied to the electromagnetic valves 9 to 11**, the ratio of air to fuel can be controlled.

The air fuel mixture control circuit of the invention further includes various sensing devices which detect the operating conditions of the engine 21. The opening of the throttle 6 is detected by a throttle sensor 23 having a DC voltage source **23*a* and a potentiometer 23*b* connected to the source 23*a*. The potentiometer 23*b*** has its tap point connected by a linkage to the throttle valve 6 such that the tap point varies in accordance with the variation of the throttle angle. An electrical signal corresponding to the throttle opening is obtained between the tap point and one terminal of the potentiometer 23*b*, and coupled to a function generator 22 which represents a plurality of function generators to be described later. Intake vacuum pressure is measured by a vacuum sensor 24 provided on the inner wall of the intake passageway 1 and converted into a proportional signal which is applied to the function generator 22. A temperature sensor 25 is provided to measure the temperature of the engine 21 and couples the temperature-related signal to the function generator 22. Also connected to the function generator 22 is a engine-speed related signal supplied from a distributor 26.

Figures 2, 3:
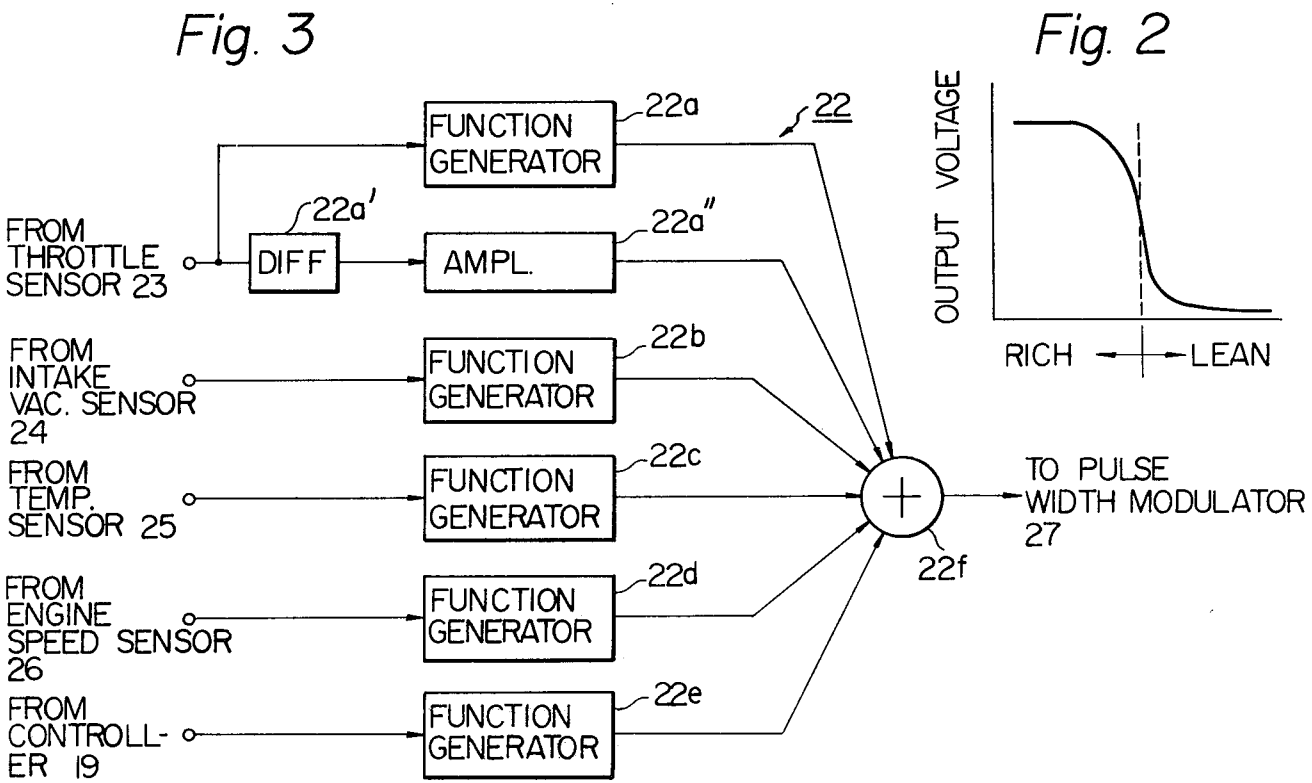
FIG. 2 is a characteristic curve of the output from an oxygen sensor used in the FIG. 1 circuit.
FIG. 3 is a schematic circuit diagram of a function generator of FIG. 1.

In order to control the air fuel mixture ratio under feedback control principle, an oxygen sensor 18 is provided on the inner wall of the exhaust pipe 16 to which is connected a catalytic converter 17. The oxygen sensor 18 produces an output voltage with a very sharp characteristic change in amplitude, almost a step change, at the stoichiometric air fuel mixture ratio, i.e., a high output voltage for a rich mixture and a low output voltage for a lean mixture as illustrated in FIG. 2. The output from the oxygen sensor 18 is connected to a comparator e.g., a differential amplifier 19 which compares it with a reference voltage and provides an output when it exceeds the reference voltage. The comparator output is connected to a proportional-integral controller 29 which has control characteristic both a proportional as well as an integrating characteristic.

The pulse width modulators 20 and 27 receive a train of pulses from a pulse generator 30 and modulate the width of the pulses in accordance with the input voltages which are respectively supplied from the output of function generator 22 and the output of PI controller 29. The output from the PI controller 29 may also be connected to the function generator 22 to be modulated thereby in accordance with a particular characteristic of the controller 29 with respect to the air fuel mixture ratio, as will be described later.

It will be noted therefore that the voltage outputs detected by the various engine condition sensors provide information on the parameters of the engine 21 prior to combustion while the voltage output obtained from the PI controller 29 provides information on the results of the combustion during each cylinder cycle. Thus, the electromagnetic on-off valves 9 and 10 are operated by the after-combustion engine operating information, while electromagnet valve 11 is operated by the pre-combustion engine operating information.

Figure 4A:
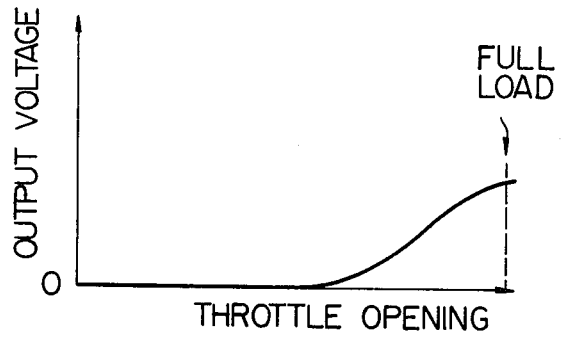
FIGS. 4A–4E show graphs representing various characteristic curves of function generators of FIG. 3.

FIG. 3 shows a detail of the function generator 22 of the circuit of FIG. 1. Function generator 22 comprises a plurality of function generators 22*a*, 22*b*, 22*c*, 22*d* and 22*e* having their inputs coupled to the output terminals of respective engine condition sensors and their outputs connected to an adder 22*f*. The function generator 22*a* is associated with the throttle sensor 23 and has a characteristic curve as shown in FIG. 4*a* in which the output voltage from the function generator 22*a* remains zero while the engine is operating under light load and rises gradually as the engine is approaching full load. The output from the throttle opening sensor 23 is also applied to a differentiator circuit 22*a*′ which detects any change in voltage at the output of throttle opening sensor 23. The change in throttle opening is amplified in voltage by amplifier 22*a*″ and fed into the adder 22*f*.

Figure 4B:
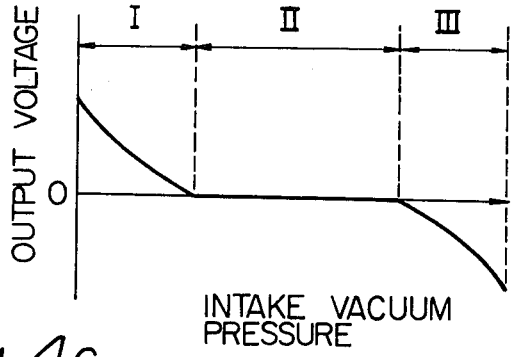

Function generator 22*b* receives the signal from intake vacuum sensor 24 and provides an output which characteristically varies with respect to the input signal, that is, the intake vacuum pressure as shown in FIG. 4*b*. While the engine is operating under near full load condition (as indicated by region I), the function generator 22*b* produces a positive output voltage which gradually falls as the engine approaches the range of middle load (indicated by region II) and a negative output voltage when the vehicle is being decelerated (region III) to provide a lean mixture.

Figure 4C:
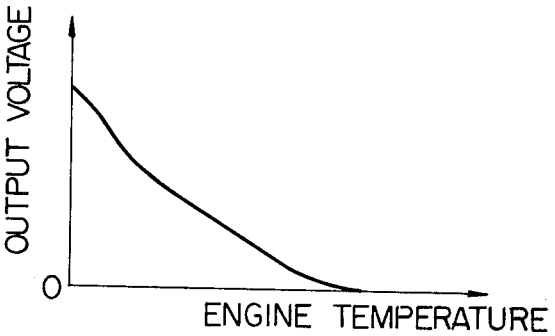

Function generator 22*c* is connected to the output of engine temperature sensor 25 and provides a signal having a characteristic voltage curve which is initially at a high amplitude when the engine is at a low temperature and gradually drops to zero as the engine temperature goes high (see FIG. 4*c*).

Figure 4D:
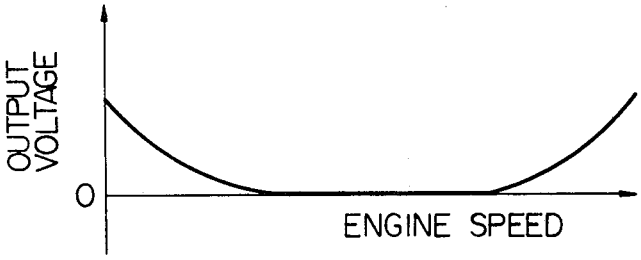

Function generator 22*d* is connected to the output of engine speed sensor 26 and provides an output voltage which is related to the engine speed as illustrated in FIG. 4*d*. The output voltage is high for low engine speeds, gradually falls to zero as the engine speed approaches the range of cruising speeds, and rises gradually as the engine is operating at high speeds.

The output voltages thus obtained by the function generators 22*a* to 22*d* and the output from amplifier 22*a*″ serve to compensate for the slow response characteristic of the PI controller because of the delay between the time of occurrence of input to the engine and the time of occurrence of the output, i.e., the emissions from which the controller output is obtained.

Figure 4E:
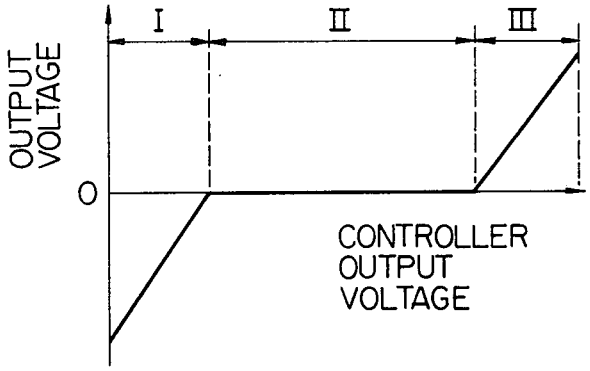

Preferably, function generator 22*e* is connected to the output of PI controller 29. FIG. 4*e* shows a characteristic curve to be derived from the output of the function generator 22*e*. When the controller voltage is outside a predetermined range as indicated by region II of FIG. 4*e*, the function generator 22*e* delivers a low voltage (region I) which linearly decreases as the controller voltage increases until it reaches zero and delivers a high voltage which linearly increases with the controller voltage (region III). Therefore, within regions I and III, mixture ratio is controlled non-linearly so that leaner and richer mixtures are provided within regions I and III, respectively, than is otherwise provided.

Figure 5:
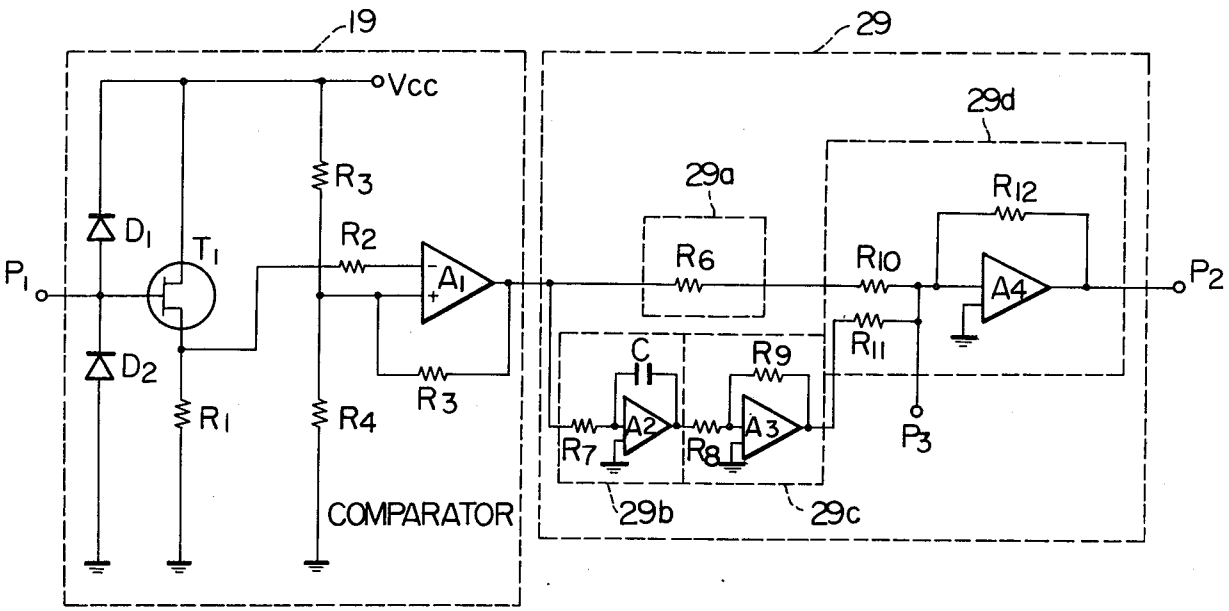
FIG. 5 is a circuit diagram of a comparator and a controller of FIG. 1.

FIG. 5 shows detailed circuits of comparator 19 and proportional-integral controller 29. In FIG. 5, a field effect transistor T1 has its source electrode connected to ground via a resistor R1 and its drain electrode connected to a voltage source Vcc, and the gate electrode connected to the input terminal $P_1$ where the voltage output from the oxygen sensor 18 is connected. A breakdown diode D1 is connected in a forward-bias direction between the gate and drain electrodes of transistor T1 and a breakdown diode D2 connected in forward-bias direction between ground and the gate electrode of the transistor. These diodes serve to protect the gate electrode of the transistor T1 from possible overvoltage potentials. The transistor T1 is thus connected in a source follower configuration and provides a high input impedance to the signal from the oxygen sensor 18. A buffer amplifier action is thus achieved by the transistor T1 to minimize the effect of an operational amplifier A1 upon the oxygen sensor 18. The inverting input terminal of the operational amplifier A1 is connected to the junction between the source electrode of transistor T1 and the load impedance R1 via a resistor R2, while the non-inverting terminal is connected to the junction between resistors R3 and R4 constituting a voltage divider connected across the voltage source Vcc and ground and to the output thereof via a resistor R5. The operational amplifier A1 compares the load impedance output with the reference voltage determined by the voltage divider and provides a low level output when the oxygen sensor output exceeds a predetermined voltage and a high level output when the input voltage relation is reversed.

The PI controller 29 comprises a proportional control circuit 29*a*, an integrating control circuit 29*b*, an inverting amplifier 29*c*, and an adder 29*d*. The proportional circuit 29*a* comprises a resistor R6 connected between the output of operational amplifier A1 and one input terminal of the adder 29*d*. The resistor R6 gives a weighted number to the oxygen sensor output. The integral control circuit 29*b* comprises an input resistor R7, an operational amplifier A2 having its inverting terminal connected to the output of comparator 19 via the resistor R7 and its noninverting terminal connected to ground, and an integrating capacitor connected across the inverting and output terminals of the operational amplifier A2. The output from the integrating control amplifier 29*b* is polarity inverted by the inverter 29*c* which comprises an operational amplifier A3 having its inverting terminal connected to the output of controller 29*b* via a resistor R8 and further connected to the output terminal thereof via a resistor R9, and its noninverting terminal connected to ground. The adder 29*d* comprises an operational amplifier A4 having its inverting terminal connected to the resistor R6 via an input resistor R10 and further connected in parallel to the output of the inverter 29*c* via another input resistor R11, and its non-inverting terminal connected to ground. This provides summation of input voltages and the result is obtained at an output terminal $P_2$.

Figure 7:
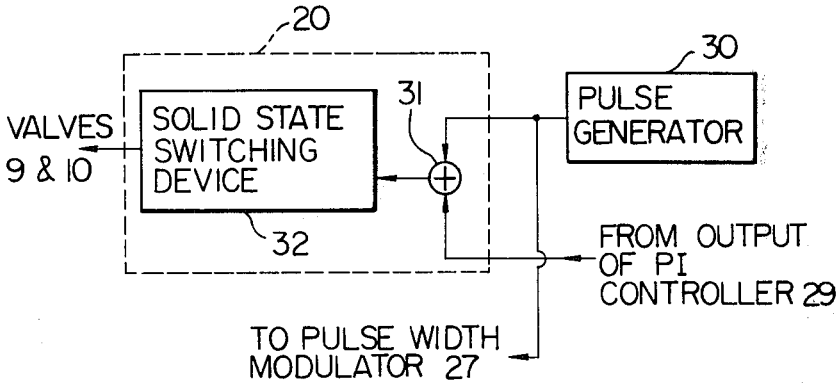
FIG. 7 is a circuit diagram required to produce the waveforms of FIG. 6.
Figure 6:
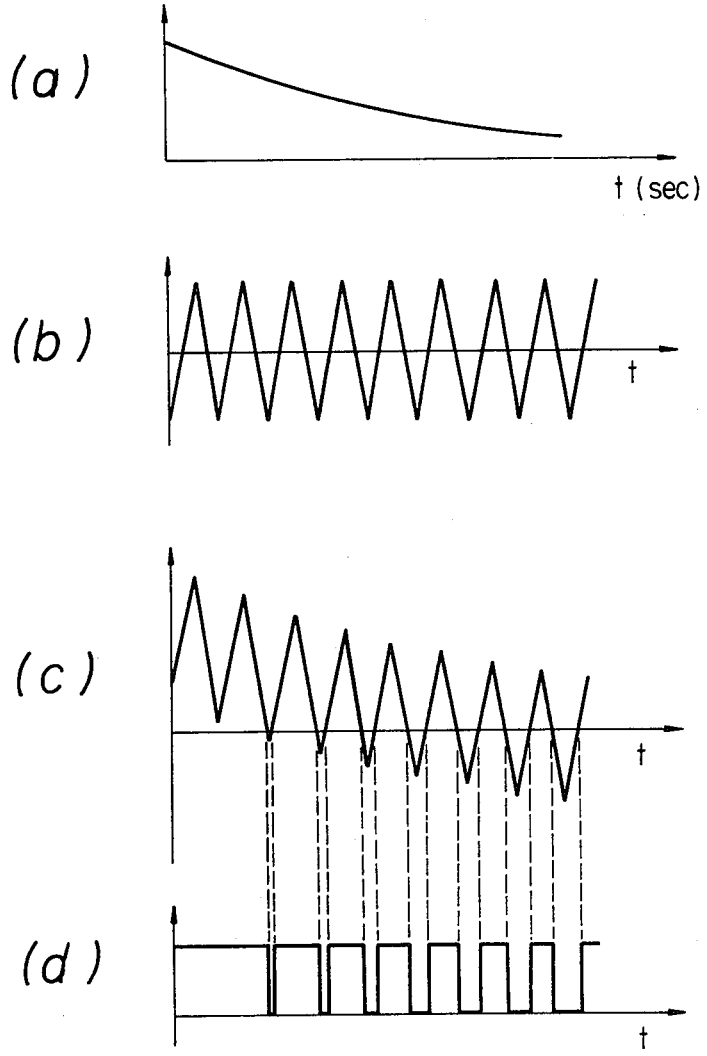
FIGS. 6A–6D are a waveform diagram showing various signals appearing in the circuit of FIG. 7.

FIG. 7 shows the detail of the pulse width modulator 20. In FIG. 7 the pulse generator 30 produces a train of regularly occurring pulses, preferably, triangular pulses as indicated in FIG. 6*b* and applies them to pulse width modulators 20 and 27. Each of the pulse width modulators 20 and 27 may comprise an adder 31 and a solid state switching device 32 such as unijunction transistor. The outputs from the PI controller 29 and from the pulse generator 30 are fed into the adder 31. If the controller output varies as shown in FIG. 6*a*, the waveform as shown in FIG. 6*c* will result at the output of adder 31. The adder output is connected to the switching device 32 which provides an output pulse (FIG. 6*d*) when the input voltage exceeds a critical value. The width of the pulse is thus determined by the voltage output from the PI controller 29. Likewise, the output from the function generator 22 determines the width of pulses obtained at the output of pulse width modulator 27.

Alternatively, the triangular pulses may be applied to an input terminal $P_3$ of the PI controller 29. With this arrangement, the adder 31 can be dispensed with and the controller output can be directly applied to the input of switching device 32.

What is claimed is:

1. Air-fuel mixture control apparatus for an internal combustion engine having an induction pipe and an exhaust pipe the apparatus comprising:

an air-fuel mixing chamber for delivery of a mixture of air and fuel to the induction pipe;

a source of fuel at atmospheric pressure;

fuel supply conduit means for delivery of fuel from said source to said mixing chamber;

air bleed conduit means for delivery of air to said mixing chamber;

an exhaust composition sensor disposed in the exhaust pipe for detecting the concentration of a composition of the exhaust emissions from the engine to provide a concentration representative signal;

means for modulating the magnitude of the concentration representative signal in accordance with a predetermined control characteristic to generate a first error correction signal;

means for detecting an operating parameter of the engine to produce a parameter representative signal;

means for modulating the magnitude of the parameter representative signal in accordance with a predetermined characteristic as a function of the detected parameter of the engine for generating a second error correction signal;

a first electromagnetic valve disposed in the air bleed conduit means to control the amount of air delivered to said mixing chamber in response to the first error correction signal; and a second electromagnetic valve disposed in the fuel supply conduit means to control the amount of fuel delivered to said mixing chamber in response to the second error correction signal.

2. Apparatus as claimed in claim 1, further comprising:

a source for generating pulses of constant duration;

a first pulse-width modulator for modulating the width of the constant duration pulses from said source in accordance with said first error correction signal;

a second pulse-width modulator for modulating the width of said constant duration pulses from said source in accordance with said second error correction signal; and means for coupling the outputs from said first and second pulse-width modulators to said first and second electromagnetic valves, respectively.

3. Apparatus as claimed in claim 2, wherein said operating parameter detecting means includes means for detecting a throttle opening of the engine.

4. Apparatus as claimed in claim 2, wherein said operating parameter detecting means includes means for detecting the vacuum pressure in said intake air passage.

5. Apparatus as claimed in claim 2, wherein said operating parameter detecting means includes means for detecting the temperature of said engine.

6. Apparatus as claimed in claim 2, wherein said operating parameter detecting means includes means for detecting the speed of said engine.

7. Apparatus as claimed in claim 2, wherein said exhaust composition sensor includes means for providing an output voltage with a sharp characteristic change in amplitude at the stoichiometric air-fuel mixture ratio, said apparatus further comprising means for comparing the output from said exhaust composition sensor with a reference voltage representing a desired air-fuel ratio to provide a signal representing the deviation of air-fuel ratio of the mixture combusted in the engine from said desired air-fuel ratio.

8. Apparatus as claimed in claim 7, further comprising a buffer amplifier through which the output from said exhaust composition sensor is connected to said comparing means.

9. Apparatus as claimed in claim 2, further comprising means responsive to the first error correction signal for generating a signal having a predetermined amplitude characteristic as a function of the magnitude of the first error correction signal, and means for connecting said generated signal to the second electromagnetic valve.

10. Apparatus as claimed in claim 3, further comprising means coupled to the throttle opening detecting means for differentiating the signal therefrom, an adder circuit receptive of the differentiated signal and the second error correction signal, and means for connecting the output from the adder circuit to the second pulsewidth modulator.

* * * * *